US008053405B2

(12) United States Patent
Narayanan et al.

(10) Patent No.: US 8,053,405 B2
(45) Date of Patent: Nov. 8, 2011

(54) FRAGRANCE DELIVERY SYSTEM

(75) Inventors: Kolazi S. Narayanan, Wayne, NJ (US); Domingo I. Jon, New York, NY (US); Donald Prettypaul, Englewood, NJ (US); Jayanti Patel, Elmwood Park, NJ (US)

(73) Assignee: ISP Investments Inc., Wilmington, DE (US)

( * ) Notice: Subject to any disclaimer, the term of this patent is extended or adjusted under 35 U.S.C. 154(b) by 803 days.

(21) Appl. No.: 11/916,313

(22) PCT Filed: May 31, 2006

(86) PCT No.: PCT/US2006/020958

§ 371 (c)(1), (2), (4) Date: Jun. 27, 2008

(87) PCT Pub. No.: WO2006/132863

PCT Pub. Date: Dec. 14, 2006

(65) Prior Publication Data

US 2011/0118163 A1 May 19, 2011

Related U.S. Application Data

(60) Provisional application No. 60/687,640, filed on Jun. 3, 2005.

(51) Int. Cl.
*C11D 3/37* (2006.01)

(52) U.S. Cl. ..... 510/476

(58) Field of Classification Search ..... 510/476
See application file for complete search history.

(56) References Cited

U.S. PATENT DOCUMENTS

| | | | | |
|---|---|---|---|---|
| 5,425,955 | A * | 6/1995 | Narayanan | 424/405 |
| 5,766,615 | A * | 6/1998 | Narayanan | 424/405 |
| 6,180,127 | B1 * | 1/2001 | Calton et al. | 424/409 |
| 6,875,732 | B2 | 4/2005 | Jurek et al. | |

OTHER PUBLICATIONS

International Search Report issued regarding International Application No. PCT/US2006/020958 (Oct. 25, 2006).

* cited by examiner

*Primary Examiner* — John Hardee
(74) *Attorney, Agent, or Firm* — William J. Davis; Thompson Hine LLP

(57) ABSTRACT

A fragrance delivery system comprises a suspension concentrate including a suspending matrix and a fragrance material which system can be diluted with water to form a use composition such as a body wash formulation.

10 Claims, No Drawings

FRAGRANCE DELIVERY SYSTEM

BACKGROUND OF THE INVENTION

1. Field of the Invention

This invention relates to a fragrance delivery system, and, more particularly, to a suspension concentrate and aqueous use composition for delivering a fragrance in an effective manner.

2. Description of the Prior Art

M. Jurek et al., in U.S. Pat. No. 6,875,732, described a laundry product containing a fragrance-containing composition which deposited a substantial proportion of its fragrance onto the fabric in an etherically pleasing manner. The fragrance delivery system was a concentrate of fragrance plus microemulsion matrix including Microflex™ (International Specialty Products) microemulsifier in compositions having a particle size of <0.1μ. This Microflex™ based system included N-octyl pyrrolidone as an essential wetting component.

SUMMARY OF THE INVENTION

What is described herein is a fragrance delivery system which includes, by weight, (a) 1-25% of an active fragrance, (b) 75-99% of a suspending matrix including:

(i) a water-insoluble, alkylated graft copolymer of polyvinylpyrrolidone, (ii) an anionic polymeric dispersant, and (iii) water.

Suitably (b) (i) is 3-15%; preferably 5-10%; (b) (ii) is 0.1-5%; preferably 0.5-2.5%, and the rest is water to 100%.

Preferably (b) (i) is a $C_{16}$-alkylated vinyl pyrrolidone in a weight ratio of 80% $C_{16}$ alkyl to 20% vinyl pyrrolidone (Ganex® 216-ISP).

Preferably (b) (ii) is an aqueous solution of methyl vinyl ether/maleic acid, butyl/ethyl half-ester, partially neutralized with sodium hydroxide as 25% solids (Easy-Sperse®-ISP).

The matrix is referred to herein as Agrimer AL® suspension (ISP).

Suitably, the matrix is a fine suspension having a particle size of 5μ or less, preferably 1μ or less, and, most preferably less than 1μ.

A feature of the invention is that the matrix does not contain any N-octyl pyrrolidone or N-methyl pyrrolidone and is a suspension, not a microemulsion.

The matrix or concentrate may be diluted with water of dilution in a range of 1:10 to 1:1000. The concentrate of the invention may be included in a body wash composition, in a detergent, gel, shampoo, conditioner or fabric softener.

Another feature of the invention is that it provides an increased residence time of fragrance upon delivery, e.g. on skin, from e.g. body wash formulation. A 6-hour or long fragrance hold time is achievable herein.

DETAILED DESCRIPTION OF THE INVENTION

Fragrance

The fragrance that can be encapsulated in the system of the present invention can be any odoriferous material and can be selected according to the desires of the fragrance creator. In general terms, such fragrance materials are characterized by a vapor pressure below atmospheric pressure at ambient temperatures. The high boiling perfume materials employed herein will most often be solids at ambient temperatures, but also can include high boiling liquids. A wide variety of chemicals are known for perfumery uses, including materials such as aldehydes, ketones, esters, and the like. More commonly, naturally occurring plant and animal oils and exudates comprising complex mixtures of various chemical components are known for use as fragrances, and such materials can be used herein. Fragrances useful for the present invention can be a single aroma chemical, relatively simple in their composition, or can comprise highly sophisticated, complex mixtures of natural and synthetic chemical components, all chosen to provide any desired odor.

Suitable fragrances which can be used in the present invention comprise, for example the high boiling components of woody/earthy bases containing exotic materials such as sandalwood oil, civet, patchouli oil, and the like. The perfumes herein can be of a light, floral fragrance, such as for example, high boiling components of rose extract, violet extract, and the like. The perfumes herein can be formulated to provide desirable fruity odors, such as for example lime, lemon, orange, and the like. The perfume can be any material of appropriate chemical and physical properties which exudes a pleasant or otherwise desirable odor when applied to fabrics. Perfume materials suitable for use in the present invention are described more fully in S. Arctander, *Perfume Flavors and Chemicals*, Vols. I and II; and the *Merck Index,* $8^{th}$ Edition, Merck & Co., Inc. both references being incorporated herein by reference.

Typical anionic surfactants include alkylbenzenesulfonates, alkanesulfonates, olefinsulfonates, alkyl ether sulfonates, glycerol ether sulfonates, alpha-methyl ester sulfonates, sulfo fatty acids, alkyl sulfates, fatty alcohol ether sulfates, glycerol ether sulfates, hydroxyl-mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, n-acyl amino acids such as, for example, acyl lactylates, acyl tartrates, acyl glutamates and acyl aspartates, alkyl oligoglucoside sulfates, protein fatty acid condensates (especially plant products based on wheat), and alkyl (ether) phosphates. Where the anionic surfactants contain polyglycol ether chains, these chains may have a conventional or, preferably, a narrowed homolog distribution. Preference is given to using alkylbenzenesulfonates, alkyl sulfates, soaps, alkanesulfonates, olefinsulfonates, methyl ester sulfonates, and mixtures thereof.

A typical fragrance is a commercial perfume delivered onto skin at different levels from the fragrance delivery system including the Agrimer® AL-22 suspension matrix. The fragrance was dispersed in this matrix and further diluted at different levels with DI water. After the initial dilution was completed, selected dilutions were evaluated for fragrance retention. Then these levels of dilution were repeated with a body wash soap formulation and further evaluated. 100 g of the concentrates were made by dissolving weighed quantities of the fragrance and the matrix in stoppered bottles and stirred in an orbital shaker for about 2 hours.

TABLE 1

| Agrimer ® AL 22 Suspension Matrix | |
|---|---|
| Ingredient | Wt. % |
| Ganex ® 216 | 8-12 |
| Easy-Sperse ® dispersant as 25% solid aqueous solution [methyl vinyl ether/maleic acid/butyl/ethyl half ester partially neutralized with sodium hydroxide] | 3-5 |
| Water | to 100 |

TABLE 2

| Concentrate made with Agrimer ® AL-22 Suspension Matrix | | |
|---|---|---|
| Ingredient | Weight percent | Weight percent |
| 10% Agrimer ® AL-22 (ISP) Suspension Matrix | 98 | 95 |
| Perfume Fragrance (Blooming Mango Mod-2) (P&G) | 2 | 5 |

Observation: Emulsion

Dilution with Deionized Water

The concentrate matrix were then diluted with DI water. The dilutions and their observations from the concentrate of Agrimer AL-22 suspension is shown in Table 3.

TABLE 3

| Dilution made from Agrimer AL-22 Suspension with Fragrance | | |
|---|---|---|
| | Run #1 | Run #2 |
| Dilution | (10% Agrimer AL-22 Suspension + perfume) | (10% Agrimer AL-22 Suspension + perfume) |
| Fragrance Conc. In concentrate | Cloudy (2%) | Cloudy (5%) |
| 1:10 | emulsion (2000 ppm fragrance) | emulsion (0.5% fragrance) |
| 1:100 | hazy (200 ppm fragrance) | hazy (500 ppm fragrance) |
| 1:1000 | opaque (20 ppm fragrance) | opaque (50 ppm fragrance) |

Dilution Made with Body Wash Formulation

A typical body wash composition is shown in Table 4.

TABLE 4

| Body Wash Formulation | | |
|---|---|---|
| Phase | Ingredient | Percent |
| A | DI water | 51.15 |
| | Standapol ES-3 | 15.00 |
| B | Mirataine CB | 15.00 |
| | Versene NA | 0.10 |
| | Glycerin | 4.50 |
| C | Germaben II-E | 0.75 |
| D | DI water | 11.25 |
| | NaCl | 2.25 |
| | Total | 100.00 |

Procedure for Making Body Wash.

1. Combine phase A ingredients with stirring. Heat to 45° C.
2. Combine phase B ingredients and heat to 45° C. with stirring.
3. When both phases are uniform, add phase B to phase A with stirring.
4. Add phase C with stirring.
5. combine phase D with mixing until uniform.
6. Slowly add phase D to batch with stirring.
7. Make up for water loss and stir to room temperature.

Selected concentrates were further diluted with the body wash formulation shown in Table 4. Concentrate 11055-118-3 was diluted at 1:10 to produce a 0.5% fragrance use solution. A control was prepared for this dilution in which fragrance was added at 5,000 ppm to the body wash.

The results are shown in Table 5.

TABLE 5

| Effect of the Fragrance Mix on Body Wash | | |
|---|---|---|
| Observation | Concentrate 11055-118-3 at 1:10 in body wash | 5,000 ppm fragrance in body wash (Control) |
| Concentrate Composition; Description | 5% fragrance in 10% Agrimer AL 22 fine suspension | Body wash |
| Fragrance Concentration after Dilution | 0.5% | 0.5% |
| Polymer: Fragrance | 2:1 | None |
| Appearance | clear | Clear |
| Viscosity | lower | OK |

Evaluation for fragrance release over time in DI water and an in-house made body wash formulation.

Selected dilutions were evaluated by a single panelist for fragrance release over time.

The dilutions with DI water along with the panelist evaluation are shown in Table 6. The same level of dilutions used with DI water was made with the body wash formulation. The results from the panelist evaluation are shown in Table 7.

One panelist was used for this evaluation. Ten (10) grams of the dilutions were placed into vials label A to E. Two vials were prepared for each sample. One was kept close, control, while the other was left open and evaluated for the fragrance level with time. The panelist was asked to rank the open vials on a degree of difference using a scale of 1 to 5 as to how different the strength is from the initial strength, control, over time with 1 meaning no change and 5 meaning large difference. Each sample was evaluated against itself with the control being kept closed given a score of 1.

TABLE 6

| Dilutions made with DI Water | | |
|---|---|---|
| Time (hours) | Concentrate 11055-118-3 at 1:10 dilution | 5,000 ppm fragrance in DI water |
| Concentrate Composition description | 5% fragrance in 10% Agrimer AL 22 fine suspension | 0.5% fragrance in DI water |
| Appearance | Cloudy | N/A |
| After dilution | Cloudy | Clear |
| Fragrance concentration after dilution | 0.5% | 0.5% |
| Analyst Observation | | |
| Polymer:fragrance | 2:1 | None |
| Time (hours) | 0.5% fragrance | 0.5% fragrance |
| 0.5 | 3.0 | 4.0 |
| 1.0 | 3.0 | 4.0 |
| 1.5 | 3.0 | 3.0 |
| 2.5 | 3.0 | 3.0 |
| 4.0 | 3.0 | 3.0 |
| 5.0 | 3.0 | 3.0 |

The degree of difference scale is as follows:

1=very similar, 2=slight difference, 3=moderate difference,

4=moderate/large difference and 5=large difference/no fragrance

TABLE 7

| Dilutions made with Body Wash Formulation | | |
|---|---|---|
| Time (hours) | Concentrate 11055-118-3 at 1:10 dilution | 5,000 ppm fragrance in body wash |
| Concentrate Composition description | 5% fragrance in 10% Agrimer AL 22 fine suspension | 0.5% fragrance in DI water |
| Appearance of Concentration | Cloudy | N/A |
| After dilution in body wash | Clear | Clear |
| Fragrance concentration after dilution | 0.5% | 0.5% |
| Polymer:fragrance | 2:1 | None |
| Viscosity | Lower | OK |
| | Analyst Observation Results | |
| 0.5, hour | 1.0 | 2.0 |
| 1.0, hour | 1.0 | 2.0 |
| 2.0, hour | 1.0 | 1.0 |
| 5.0, hour | 1.0 | 1.0 |
| 6.5, hour | 2.0 | 1.0 |

A 5 wt. % "commercial fragrance composite" obtained from IFF Corp. was suspended in the matrix shown in Table 1 by mixing 5 parts of the fragrance in 95 parts of the matrix. Then 4 parts of the 5% fragrance suspension was added to 96 parts of three different IFF detergent matrices individually, generating three "detergent matrices" with fragrance incorporated along with the matrix of Table 1. These were evaluated for fragrance retention as in the case of body wash evaluation. The compositions were optically clear. Compositions containing the matrix of instant invention showed much higher retention of fragrance compared to control compositions without such matrix.

The detergent matrices were also evaluated in a wash and dry cycle with similar results.

While the invention has been described with particular reference to certain embodiments thereof, it will be understood that changes and modifications may be made which are within the skill of the art. Accordingly, it is intended to be bound only by the following claims, in which:

What is claimed is:

1. A fragrance delivery system comprising, by weight:

(a) 1 to 25% of an active fragrance, (b) 75 to 99% of a suspension concentrate matrix including:

(i) a water-insoluble alkylated graft copolymer of polyvinyl pyrrolidone, (ii) an anionic polymeric dispersant comprising an aqueous solution of methyl vinyl ether/maleic acid/butyl/ethyl half ester, partially neutralized with sodium hydroxide, and (iii) water.

2. A fragrance delivery system according to claim 1 wherein (a) is 5-10%; (b) (i) is 3-15%; (b) (ii) is 0.1-5%.

3. A fragrance delivery system according to claim 2 wherein (b) (i) is 8-12% and (b) (ii) is 0.5-2.5%.

4. A fragrance delivery system according to claim 1 wherein (b) (i) is a $C_{16}$-alkylated copolymer in a weight ratio of 80% $C_{16}$ alkyl to 20% vinyl pyrrolidone.

5. A fragrance delivery system according to claim 1 wherein (b) (ii) is a 25% solids solution.

6. A fragrance delivery system according to claim 1 wherein (b) is a fine suspension matrix having a particle size of 5μ or less.

7. A fragrance delivery system according to claim 6 wherein said particle size is 1μ or less.

8. A fragrance delivery system according to claim 7 wherein said particle size is less than 1μ.

9. A use composition comprising the fragrance delivery system of claim 1 and water of dilution in a range of 1:10 to 1:1000.

10. A use composition according to claim 9 which is a body wash, detergent, gel, shampoo, conditioner or fabric softener formulation.

* * * * *